United States Patent [19]

Venot

[11] Patent Number: 4,691,743

[45] Date of Patent: Sep. 8, 1987

[54] METHOD AND DEVICE FOR REMOVAL OF WASTE SLIVERS IN A WEAVING LOOM

[75] Inventor: Jean Venot, Mulhouse, France

[73] Assignee: Societe Alsacienne de Construction de Material Textile, France

[21] Appl. No.: 888,225

[22] Filed: Jul. 23, 1986

[51] Int. Cl.[4] ..... D03D 49/00

[52] U.S. Cl. ..... 139/291 C; 139/302; 139/304; 57/344

[58] Field of Search ..... 139/291 C, 429, 430, 139/194, 302, 303, 304; 57/341, 342, 343, 344 X, 345, 346

[56] References Cited

U.S. PATENT DOCUMENTS

| | | | |
|---|---|---|---|
| 3,297,057 | 1/1967 | Mizuno et al. | 139/302 |
| 3,529,637 | 9/1970 | Nydam | 139/194 |
| 4,453,572 | 6/1984 | Key | 139/430 |
| 4,513,791 | 4/1985 | Dillon | 139/429 |

*Primary Examiner*—Henry S. Jaudon

*Attorney, Agent, or Firm*—Wegner & Bretschneider

[57] ABSTRACT

In order to remove waste slivers produced by cutting false selvedges in a weaving loom, at least two slivers are introduced into a rotating feed duct and subjected to a false twist, thus automatically balancing the tensions of the different slivers. The cord thus formed falls down from the feed duct outlet onto a delivery coiler on which the spiral turns are successively allowed to slip off the rotating coiler under the control of a brake system and then discharged into a can.

5 Claims, 3 Drawing Figures

METHOD AND DEVICE FOR REMOVAL OF WASTE SLIVERS IN A WEAVING LOOM

BACKGROUND OF THE INVENTION

1. Field of the Invention

The present invention relates to a method and a device for coiling and removing waste slivers produced by cutting false selvedges of one or a number of edges of cloth during the weaving operation.

2. Description of the Prior Art

At the present time, slivers which have been separated from the edge of a piece of cloth are removed by different means. For example, the slivers can be taken up by gripping between two toothed or roughened wheels which rotate at constant speed, the slivers being then allowed to fall to the ground or into a can. As a general rule, the loom has one pair of wheels for each sliver. In a system of this type, the tensions of the slivers are not perfectly constant or balanced and cannot be regulated, thus resulting in breakages and stoppages of the loom for reasons which are not specifically related to the weaving mechanism.

In order to eliminate these undesirable stoppages and thus to increase the productivity of the loom, the present invention proposes a method and a device for automatically balancing the tensions of the slivers.

SUMMARY OF THE INVENTION

In accordance with the invention, the method for removing waste slivers produced by cutting false selvedges, of the type comprising a step of coiling said slivers in the form of spiral turns and a discharge step, is distinguished by the fact that said slivers are coiled simultaneously in the form of a single cord and that said cord is subjected to a false twist for automatically balancing the tensions of the different slivers.

The device for the practical application of the method summarized in the foregoing essentially comprises in combination:

a coiler of the yarn-delivery type, the perimeter of which varies along the generator-line;

a bobbin-braking system;

a cord feed duct which is driven in rotation, said feed duct being capable of placing the cord on the coiler on the side corresponding to its longest perimeter and being capable of imparting a false twist to said cord.

BRIEF DESCRIPTION OF THE DRAWINGS

Other features of the invention will be more apparent to those skilled in the art upon consideration of the following description and accompanying drawings, wherein.

DESCRIPTION OF THE PREFERRED EMBODIMENT

Figures 1, 2:
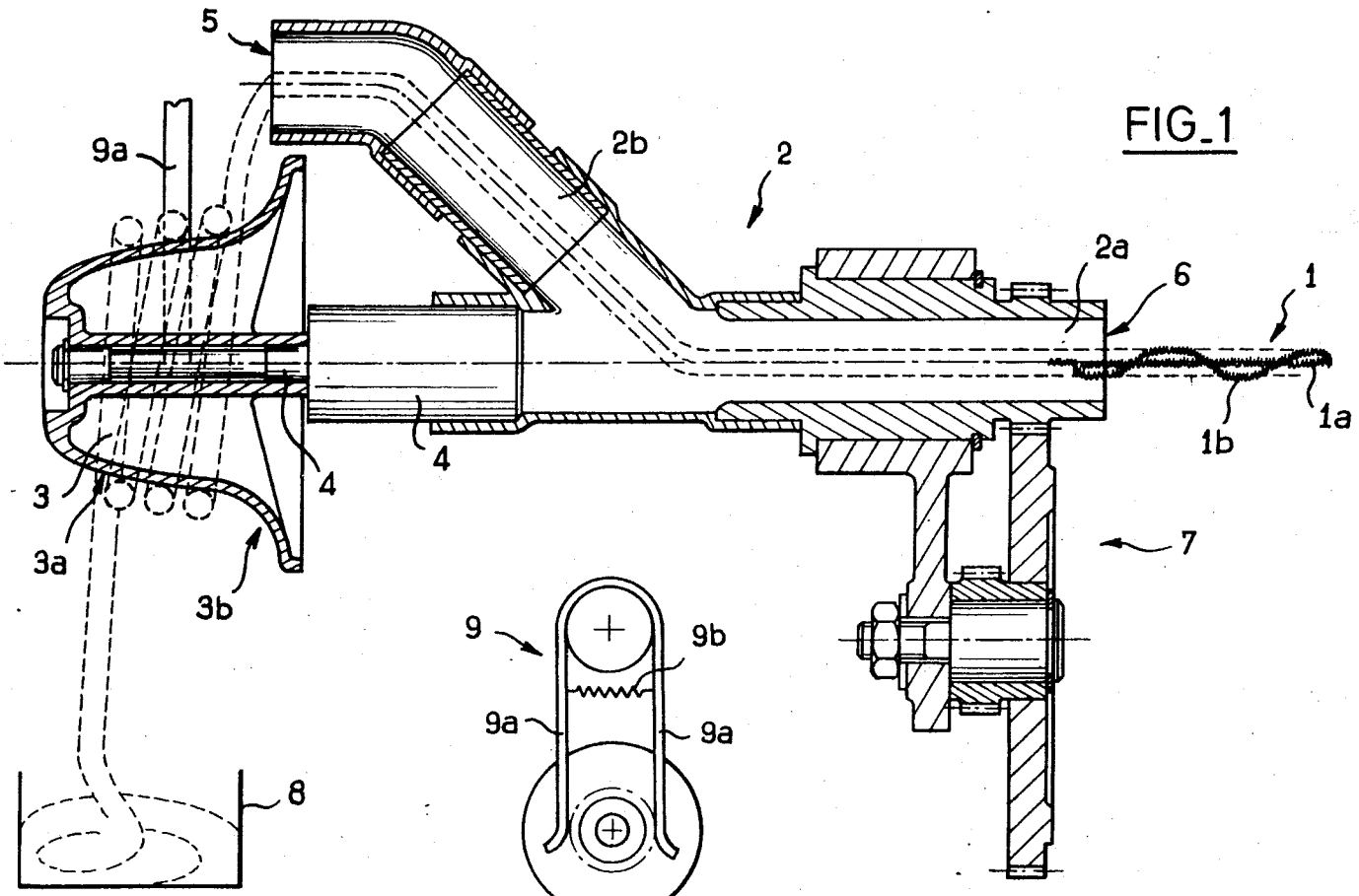
FIG. 1 is a longitudinal sectional view of the device in accordance with the invention.
FIG. 2 is an end view of the coiler and of the brake system.

The device in accordance with the invention is mainly constituted by a feed duct 2, a delivery coiler 3 and a brake system 9.

As shown by way of example in FIG. 1 without any limitation being implied, the coiler 3 is constituted by a bell-shaped bobbin or delivery reel having a substantially convex zone 3*a* and a substantially concave zone 3*b* in order to facilitate removal of the spiral turns formed around the coiler as will hereinafter be explained in detail.

Any other type of coiling device which performs the same function would be suitable. Examples of alternative devices include a bobbin composed of two sections having different conicities or else having a cylindrical portion and a plurality of pins or bars maintained in an inclined position with respect to the cylindrical portion by means of a flange in accordance with a technique which is already known in weft-yarn let-off motions.

The aforementioned delivery coiler 3 is formed of plastic material, for example, and mounted to rotate freely on a shaft 4.

By way of example, the feed duct 2 is composed of a circular-section tube which is elbowed in such a manner that a portion 2*a* of the feed duct is located in the axis of rotation of the shaft 4 and that a portion 2*b* extends up to the periphery of the coiler.

The exit opening of the feed duct 2 is located opposite to that side of the coiler which has the longest perimeter and externally of this latter.

In addition, the feed duct 2 is driven in rotation by any suitable means such as, for example, a gearing-up mechanism 7 which is driven by the shaft of the cloth takeup roller (not shown in the drawings).

However, the drive mechanism just mentioned does not imply any limitation and any other suitable system may accordingly be contemplated, whether it is synchronized with the shaft of the loom or not.

The brake system 9 of the preferred embodiment of the invention is composed of two bars 9*a* placed on each side of the delivery coiler 3 and extending at right angles to the axis of rotation of the device, said bars being capable of applying the spiral turns against the bobbin (as shown in the diagram of FIG. 2). Bars 9*a* are biased against the surface of coiler 3 by their own resiliency or by the force of spring 9*b*, as shown in FIG. 2. Thus, in operation, the ends of the bars are in contact with the spiral turns wound on the collar. As will be readily apparent, however, it would also be possible to make use of a brake system of a different type such as a magnetic system, for example.

Figure 3:
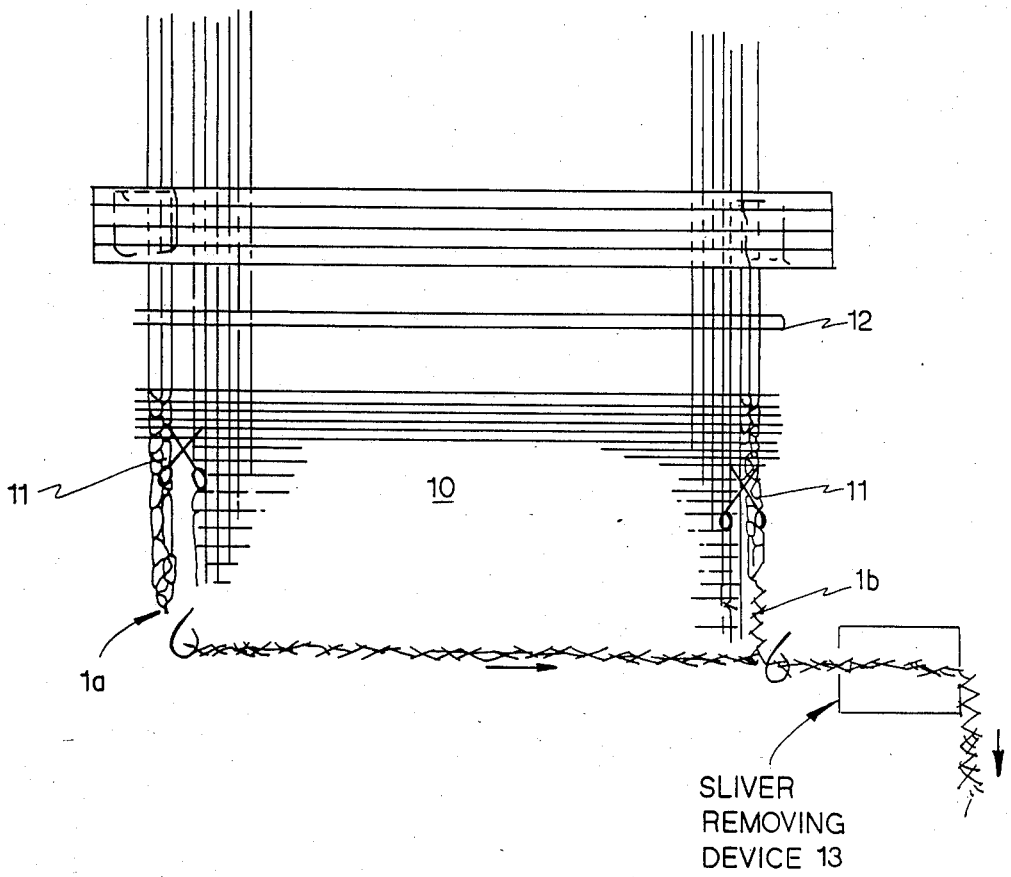
FIG. 3 is a schematic view of a "leno selvedge system" producing two waste slivers to be removed by the present invention.

During operation, left and right waste slivers 1*a*, 1*b* are removed from fabric 10 by cutting mechanism 11, as illustrated in FIG. 3 which shows a conventional "leno selvedge system" known in the prior art. Reed 12 separates the yarns during a weaving process in known fashion. A cord 1 formed by at least two slivers 1*a* and 1*b* produced by cutting two false selvedges of a piece of cloth is introduced into the inlet 6 of the feed duct 2, discharged through the outlet 5 of said duct 2 and deposited on the coiler 3 in the vicinity of its longest perimeter. The path followed by the cord as well as a few spiral turns of the cord on the coiler are represented schematically by the dashed lines in FIG. 1.

Under the action of rotation of the feed duct 2, the cord 1 is subjected to a false twist which has the effect of winding the slivers around each other. The cord 1 is then deposited on the coiler 3 in the form of successive spiral turns. Under the action of the conicity or taper of the portion 3*b* of the coiler 3, said successive spiral turns slide in a manner known per se towards the shortest-perimeter zone 3*a* of said coiler and are distributed thereon in the form of at least one layer of spiral turns.

This layer of spiral turns is held in position by the brake system 9, then discharged automatically into a collecting can 8 in a manner known per se, on that side of the coiler 3 which has the shortest perimeter.

Another function of the brake system is to determine the resultant tension on the cord 1. Thus, in the event that one of the two slivers 1*b* is less taut than the second sliver 1*a*, the sliver 1*b* wraps around the sliver 1*a* until the different lengths are compensated and the tensions of the two slivers are restored to equilibrium.

Thus, during operation, the tensions of the two slivers are automatically balanced and any potential danger of breakage is considerably reduced.

The performance of the device in accordance with the invention is improved in proportion to the amount by which the speed of rotation of the feed duct 2 exceeds the speed of rotation of the cloth takeup roller since the false twist of the cord is greater and the regulation is more efficient.

Furthermore, the device in accordance with the invention offers the advantage of being self-starting, which is a nôvel feature not encountered in any known device of the prior art.

What is claimed is:

1. A method for removing the two waste slivers by cutting the two false selvedges on the two lateral edges of a sheet of fabric woven on a loom, comprising coiling said two waste slivers in the form of spiral turns around a coiler, biasing said spiral turns against said coiler by applying a braking pressure to said spiral turns, and discharging said spiral turns from said coiler, wherein said two waste slivers are coiled in the form of a single cord, said cord being subjected to a false twist for automatically balancing the tensions of said two waste slivers.

2. A device for removing the two waste slivers produced by cutting the two false selvedges on the two lateral edges of a sheet of fabric woven on a loom, said device comprising:

a bell-shaped coiler having a larger diameter end and a smaller diameter end, said coiler receiving the two waste slivers in the form of spiral turns about said coiler;

a bobbin-braking system for biasing said spiral turns against said coiler; and a rotationally driven means for feeding said waste slivers onto said larger diameter end of said coiler, whereby a false twist is imparted to said waste slivers for automatically balancing the tensions of the different slivers.

3. A device according to claim 2, wherein the bobbin has a concave zone and a convex zone.

4. A device according to claim 2, wherein the brake system is composed of two bars resiliently applied against the bobbin.

5. A device for removing the two waste slivers produced by cutting the two false selvedges on the two lateral edges of a sheet of fabric woven on a loom, as in claim 2 wherein said means for feeding comprises:

(a) a duct portion having a common axis with said coiler and having an inlet end distal therefrom;

(b) an elbow portion intermediate said inlet end and said coiler;

(c) said elbow portion terminating in an exit end on an axis parallel to said common axis; and (d) said exit end lying in the vicinity of said large diameter end of said coiler, so that said waste slivers are delivered onto said coiler to form said spiral turns.

* * * * *